United States Patent [19]

Okutsu

[11] 4,288,936

[45] Sep. 15, 1981

[54] WALL-HANGING TYPE MAGNETIC DISPLAYING DEVICE

[75] Inventor: Hiroyasu Okutsu, Zama, Japan

[73] Assignee: Pilot Man-Nen-Hitsu Kabushiki Kaisha, Tokyo, Japan

[21] Appl. No.: 83,708

[22] Filed: Oct. 11, 1979

[30] Foreign Application Priority Data

Oct. 16, 1978 [JP] Japan ..... 53/141982[U]

[51] Int. Cl.[3] ..... G09F 19/00

[52] U.S. Cl. ..... 40/426; 40/449; 46/240; 434/409

[58] Field of Search ..... 40/406, 426, 439, 447, 40/449; 35/66, 7 R, 7 A; 340/763, 764, 372, 378.2; 46/240; 434/409, 422

[56] References Cited

U.S. PATENT DOCUMENTS

| | | | |
|---|---|---|---|
| 3,460,276 | 8/1969 | Payne | 40/449 |
| 3,509,644 | 5/1970 | Santell et al. | 35/66 |
| 3,591,939 | 7/1971 | Payne | 40/449 |
| 3,648,269 | 3/1972 | Rosenweig et al. | 40/449 |
| 3,938,263 | 2/1976 | Tate | 40/426 |
| 4,143,472 | 3/1979 | Murata et al. | 35/66 |

*Primary Examiner*—Gene Mancene
*Assistant Examiner*—G. Lee Skillington
*Attorney, Agent, or Firm*—Sughrue, Mion, Zinn, Macpeak & Seas

[57] ABSTRACT

A magnetic displaying device adapted for hanging on a wall including a displaying panel made of a hanging panel and a parallel disposed magnetic displaying panel between which is disposed a liquid containing magnetic particles. A translatable erasing magnet is arranged perpendicular to the downward direction of the device and coupled to a magnet lifting mechanism. The erasing magnet rests at either the upper or lower end of the panel and moves up and down through guiding means such as rails. A string or the like coupled to the lifting mechanism is pulled downwardly to move the erasing magnet.

12 Claims, 33 Drawing Figures

WALL-HANGING TYPE MAGNETIC DISPLAYING DEVICE

BACKGROUND OF THE INVENTION

The invention relates to a magnetic displaying device which is intended to be hung on a wall (hereinafter referred to as a "a wall-hanging type magnetic displaying device" when applicable) which includes a displaying panel having a magnetic panel enclosing a dispersed liquid containing magnetic particles, an erasing magnet slidably provided on the rear surface of the magnetic panel, and a displaying magnet for moving the magnetic particles in the dispersed liquid.

In such a magnetic displaying device, a liquid containing dispersed magnetic particles is enclosed between two substrates. Accordingly, when the magnetic force of the displaying magnet is applied to the magnetic particles through the substrate on the displaying side, only the magnetic particles affected by the magnetic force are moved as a result of which contrast occurs in the liquid providing a display on the panel. If the magnetic force of the erasing magnet is exerted on the magnetic perticles through the opposite substrate, the magnetic particles are moved towards the substrate as a result of which the display is erased.

In order to prevent sedimentation of the magnetic particles which have formed a display, a yield value is provided in the dispersed liquid. That is, the magnetic particles are maintained at the positions in the liquid where they have been moved by the magnetic force. Accordingly, the erasing magnet must have a magnetic force sufficient to overcome the yield value to move the magnetic particles in the liquid. If the erasing magnet passes over the magnetic particles before the movement of the magnetic particles has been completed the magnetic particles discontinue their movement. Accordingly, the magnetic displaying device is disadvantageous in that it is necessary to scan the displaying panel with the erasing magnet many times to complete erase the display.

This difficulty becomes especially troublesome when the magnetic panel is used on a wall as in that case it will typically be used as a general purpose magnetic panel by many persons and consequently the erasing magnet scanning speed is not always constant with the result that displays cannot be erased completely.

In addition, the wall-hanging type magnetic displaying device may installed at a position on the wall which is high above a person, for instance. In this case, it is difficult for a small person such as a child to satisfactorily operate the erasing magnet to erase the display. Thus, the operability of the device in erasing displays may be considered poor when such a conventional magnetic display device is installed at a high position.

SUMMARY OF THE INVENTION

Thus, it is an object of the invention to provide a wall-hanging type magnetic display device which may be easily, completely and consistently erased regardless of the erasing magnet scanning speed.

Provided according to the invention is a wall-hanging type magnetic display device which includes a displaying panel and a hanging panel with a magnetic displaying section incorporating a dispersed liquid in which magnetic particles are dispersed, a predetermined space being provided between the hanging panel and the displaying panel, magnet lifting means including retaining means fixedly secured to one or both of the two panels and pulling means coupled to the retaining means, an erasing magnet member with a magnet arranged perpendicularly to the down-direction of the device hung by being connected to one end of the pulling means so that the magnet is positioned at the upper or lower end portion of the panel, guide means provided for one or both of the panels to guide the magnet, and operating means connected to one of the pulling means and erasing magnet member so that the operating means extends in the down-direction of the device, and a displaying magnet adapted to move the magnetic particles in the dispersed liquid.

With this invention, the magnet lifting member is provided between the panel having the magnetic displaying section and the hanging panel which is spaced therefrom. The erasing magnet member is connected to one end of the pulling member of the magnet lifting member so that the erasing magnet member hangs down. Furthermore, the operating member is coupled to the pulling member of the erasing magnet member. To readily and positively erase a display on the magnetic displaying section of the device which is installed at a high position on a wall, the magnet is reciprocated in the up and down direction of the magnetic displaying section.

In other words, whenever the operating member is pulled and released, the erasing magnet member is reciprocated by the biasing action of the magnet lifting member. Accordingly, even if the erasing magnet passes over the magnetic particles before movement of the magnetic particles is completed, the erasing magnet passes over the magnetic particles again which continues the movement of the particles.

The operating member is pulled down to scan the panel with the erasing magnet. Accordingly, even if the device is installed at a position high above one's head, the display can be readily erased by a small person such as a child. Furthermore, all that is required is that the length of the operating member be long enough to easily reached. Accordingly, the operating member is short in length which facilitates the packaging of the device. This feature is considerably advantageous for shipping and storing the devices.

In the invention, the magnet lifting member may be spring means which operates to set the magnet of the erasing magnet member at the upper portion of the panel or pulley means which operates to set the magnet of the erasing magnet member at the lower portion of the panel. The spring means may be a spring the two ends of which are connected to the erasing magnet member so as to pull the latter and the retaining part upwards or a spring which lies above the retaining part with one end connected to the erasing magnet member and the other end fastened to the panel. Each of these spring arrangements pulls the erasing magnet member to the upper portion of the panel so that even if an impact is suddenly exerted on the device while it is being shipped or stored, the erasing magnet member is firmly held. Thus, the device according to the invention entails no problems in storage.

If desired, the erasing magnet can be reciprocated only in the upper portion of the magnetic displaying section so that accordingly it is possible to erase only a part of the display in the upper portion of the magnetic displaying section.

If used, the pulleys may be mounted on stationary shafts with a string member laid over them. Alternatively, the pulleys may be mounted on stationary shafts and movable shafts and a string member laid over them in a suitable combination. In each of these pulley arrangements, the return to the lower end portion is effected by the weight of the erasing magnet member and therefore the returning speed of the erasing magnet member can be made faster than that for the case of the spring and its initial performance can be maintained over long period of time. For these reasons, the pulley arrangements are superior to the use of springs. Still further in accordance with invention, the string member may be laid directly over the stationary shafts or the movable shafts without using the pulleys.

In the invention, any one of the above-described magnet lifting techniques can be employed. However, the pulley means is preferred in view of the above-described effects.

The erasing magnet member employed in the invention may be a combination of a permanent magnet and its holder or the combination of a permanent magnet, its holder and link mechanism which is stretchable vertically and couples the magnet holder to the magnetic panel. A variety of link mechanisms may be employed although a parallel ruler-type link mechanism extensively used in the field of drafting machines is preferable in that it can prevent the lateral displacement of the erasing magnet.

It is also preferable that there is provided a space between the magnet and the panel having the magnetic displaying section. In this case, frictional movement of the magnet which may result when the magnet attracts the magnetic displaying section can be eliminated and therefore the magnet can smoothly slide past the magnet lifting member. The space may be provided by covering the magnetic particle attracting surface of the magnet with a suitable material. Furthermore, the space may be provided by protrusions which extend from the magnetic holder towards the magnetic panel and along both sides in the longitudinal direction of the magnet so that the outer ends of the protrusions are higher than the outer end of the magnet. This method of providing the space is most suitable because the magnetic force of the magnet is not affected.

The operating member employed in the invention is connected to the magnet lifting member or the erasing magnet means. However, in the case where one or more springs are used for the magnet lifting member, the operating member is connected to the erasing magnet member and in the case where the magnet lifting member is of the pulley type, the operating member is connected to the pulling means of the pulley means. Depending on the kind of magnet lifting member, a rigid operating member or a string member one is appropriately employed.

In the invention, guide means is provided for guiding the magnet along the panel. Accordingly, even if a wall on which the device is placed is inclined, the erasing magnet can be moved in parallel with the magnetic displaying section so that the magnetic force thereof is satisfactorily exerted on the magnetic particles in the dispersed liquid. The guide means can be made of one or two rails, or it can be constructed as a string or strings laid over pulleys or rollers.

In this invention, a plurality of sets of magnet lifting members, erasing magnet members, magnet guide members and operating members may be provided on one panel. In this case, the display on the magnetic displaying section can be partially erased.

It is preferable that the magnetic displaying section of the invention be enclosed between two substrates at least one of which is transparent. Between the substrates is disposed a dispersed liquid which is constituted by magnetic particles, a dispersing medium, a fine grain thickener and, if necessary, a coloring agent with the liquid having a yield value more than 5 dyne/cm$^2$. The term "yield value" as used herein is intended to mean the limit value (minimum value) of stress which causes a liquid to flow. The yield value is the stress at the point A in a liquid fluidity curve shown in FIG. 1, for instance.

Suitable for the thickener used to provide an appropriate yield value for the dispersed liquid are fine powder silicic acid or fine powder silicate which is made from anhydrous silicic acid, hydrous silicic acid, hydrous calcium silicate, hydrous aluminum silicate, silica powder, diatomaceous earth, kaolin, hard clay, soft clay, bentonite, or organic bentonite or the mixtures of these materials, almina, extremely fine calcium carbonate, light fine calcium carbonate, extremely fine activated calcium carbonate, heavy calcium carbonate, hydrous basic magnesium carbonate, barium sulfate, or benzidine yellow. These thickeners may be used singly or in combination. Furthermore, organic thickeners such as olefin polymers, olefin copolymers, polyalkylstyren, wax, metal soap, fatty acid amide, dextrin fatty acid ester, hydroxypropyl cellulose ester, sucrose fatty acid ester, acyl aminoacid ester, starch fatty acid ester and dibenzidene sorbitol can be used solely or in combination. The use of such organic-thickeners can prevent a decrease of the yield value which otherwise may be caused by foreign matter which may be mixed in during the manufacture so that a clear display can be ensured.

In order to give "hiding power" to the dispersed liquid in which the magnetic particles are dispersed, and to color the dispersed liquid, thereby to increase the color contrast between a display formed by the magnetic particles and the background, a coloring agent selected from the group of white pigment, yellow pigment and other such dyes or pigments is added to the dispersed liquid. In the case where the thickener itself has sufficient hiding power and has a color clearly different from the color of the magnetic particles, it is unnecessary to add such a coloring agent to the dispersed liquid.

The dispersing medium may be a polar dispersing medium such as water or one of the glycols or a nonpolar dispersing medium such as an organic solvent or oil.

The magnetic particles may be an oxide magnetic material of, for instance, black magnetite, $\gamma$-haematite, chromium dioside or ferrite or of the metallic magnetic material of iron, cobalt or nickel alloy, or particles of these materials.

Among the two substrates confronted with each other, one substrate on the display side may be semi-transparent depending on the use of the device. That is, it may be a plastic plate or a glass plate. It is not always necessary that the other substrate is transparent. It may for example, be a plastic, glass or metal plate, or a plastic and metal lamination board. The plastic or glass plate may be colored or not as desired. It is necessary to prevent leakage of the dispersed liquid enclosed between the two substrate. For this purpose, the two substrates are sealed with a strip provided along the periphery thereof or with a bonding agent. Alternatively, the peripheral portions of the two substrates may be welded together.

A multi-cell board having a number of through-holes may be disposed between the two substrates, namely the displaying substrates and a bottom substrate, so that the dispersed liquid is enclosed in the through-holes. In this case, a clear display high in contrast can be obtained. In this connection, a honeycomb core may be used as the multi-cell board.

Such a magnetic panel can be combined with a panel having a window to form the aforementioned magnetic displaying section. This method is preferable because the peripheral portion of the magnetic panel is covered. If a reinforcing board is provided on the rear surface of the magnetic panel, the rigidity of the magnetic panel can be preferably increased.

It is necessary to suitably adjust the contact area of the displaying magnet employed in the invention depending on the purpose of use. In general, the contact area is 1 to 3 mm in diameter. However, a displaying magnet having a contact area of the order of 10 to 80 mm in diameter is suitable to write heavy and large characters or the like. In addition, good results can be obtained by using displaying magnets whose contact surfaces have characters, symbols, figures, etc.

The displaying magnet may be produced by providing a permanent magnet on the top of a cylinder so that it is in the form of a writing pen. Also, a pen-shaped displaying magnet constructed as an electromagnet may be used.

BRIEF DESCRIPTION OF THE INVENTION

DESCRIPTION OF THE PREFERRED EMBODIMENTS

Figure 1:
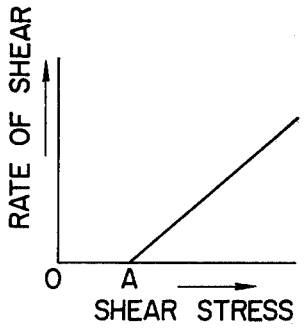
FIG. 1 is a graphical representation indicating stress with strain rate for a description of the yield value of a magnetic panel used in one embodiment of this invention.
Figure 2:
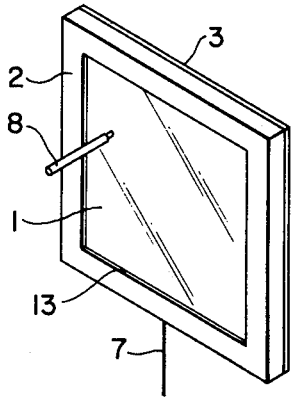
FIG. 2 is a perspective view of a magnetic displaying device according to the invention.
Figure 3:
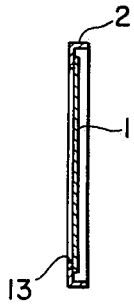
FIG. 3 is a sectional view of a panel having a magnetic displaying section in the device shown in FIG. 2.

The invention will be described with reference to the preferred embodiments shown in the accompanying drawings.

A wall-hanging type magnetic display device as shown in FIGS. 2 through 6 includes a magnetic displaying section 1, a panel 2, a hanging panel 3, magnet lifting members 4, an erasing magnet member 5, guide members 6, an operating member 7, and a displaying magnet 8.

Figure 4:
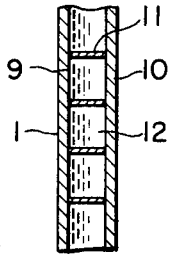
FIG. 4 is an enlarged diagram showing a part of the magnetic displaying section.
Figure 5:
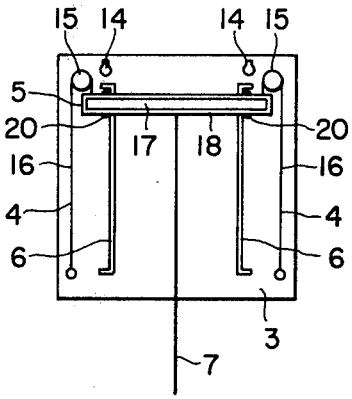
FIG. 5 is a front view of the device from which the panel with the magnetic displaying section has been removed.
Figure 6:
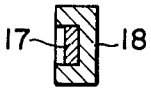
FIG. 6 is an enlarged sectional view of a first example of an erasing magnet member employed in the device according to the invention.

In the magnetic displaying section 1, two transparent or semi-transparent substrates 9 and 10 are disposed confronting one another as shown in FIG. 4 so as to form a space in which liquid can be enclosed and a multi-cell structure 11 having a number of cells is provided in the liquid enclosing space. Enclosed in the cells is a dispersed liquid 12 composed of a thickener, magnetic particles, a coloring agent and a dispersing medium. When magnetic force is exerted on the dispersed liquid 12 with the displaying magnet 8, the magnetic particles are moved as a result of which a figure such as for instance a block figure on a white background which is clear and high in contrast and tone can be displayed.

The magnetic displaying section 1 is fixedly secured to the window 13 of the panel 2. The hanging panel 3 is coupled to the panel 2 with a predetermined space therebetween. The hanging panel 3 is provided with hanging members 14 for hanging the device on the wall for instance.

The magnet lifting member 4 includes pulley-shaped retaining member 15 fixedly secured to the hanging panel and pulling members 16 made of rubber threads, each pulling member being laid over the respective pulley member 15 and connected to the panel at one end. One pair of pulling member 16 are provided in the downward direction of the hanging panel 3 or along both sides thereof.

The erasing magnet member 5 includes a magnet 17 and a box-shaped magnet holding member 18 in which the magnet 17 is incorporated. The erasing magnet member 5 is hung down with the ends of the magnet holding member 18 connected to the ends of the pulling members 16. The magnet 17 is disposed on the rear surface of the magnetic displaying section with a clearance therebetween. The clearance is provided by the peripheral frame of the magnet holding part 18, the frame being higher than the outer surface of the magnet 17. Thus, the magnet 17 is placed on the magnetic displaying section 1 with a predetermined distance or clearance therebetween.

The two guide sections 6 protrude from the panel 3. In other words, the guide sections 6 are parallel rails which extend in the downward direction between the magnet lifting members 4. The parallel rails are disposed behind the erasing magnet member 5 to guide the latter 5.

The magnet holding member 8 is provided with stopper receivers 20 cooperating with the ends of the guide section 6 to prevent the erasing magnet member 5 from coming off.

The operating section 7 is a string connected to the erasing magnet member 5. As the operating section 7 is pulled down, the erasing magnet member 5 moves downwardly along the guide section 6 as a result of which the magnetic field of the magnet 17 acts on the magnetic particles in the dispersed liquid 12 which have formed a displayed configuration attracting the particles to thereby erase the configuration.

When the operating section 7 is released, the magnet 17 is pulled by the biasing action of the pulling members 16 to its original position while allowing the magnetic field to act on the magnetic particles in the dispersed liquid 17 as it moves.

Figure 7:
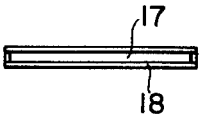
FIGS. 7 and 8 are enlarged sectional views showing second and third examples of the erasing magnet member.
Figure 8:
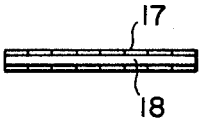
Figure 9:
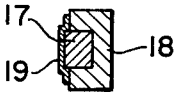
FIG. 9 is an enlarged sectional view showing a fourth example of the erasing magnet member.

FIGS. 7 and 8 show modifications of the technique of providing the aforementioned clearance. In FIG. 7, the magnetic holder 18 is made of a channel member and the clearance is formed on both sides in the longitudinal direction of the magnet 17. In FIG. 8, the magnetic holder 18 is made of a flat plate and the clearance is formed by providing protrusions at several positions on both sides in the longitudinal direction of the magnet 17. In FIG. 9, a spacer 19 is formed by covering the magnetic particle attracting surface of the magnet 17 with aluminum foil.

FIGS. 10 through 33 show various modifications of the construction and arrangement of the erasing magnet member, magnet lifting units, magnet guide sections, and operating section. Like reference numbers designate like components as employed in the embodiment shown in FIG. 5. In the modification shown in FIG. 10, the operating member 7 is made of a rigid material and the magnet lifting member 5 has a retaining part 15 fixedly secured to the hanging panel 3. A pulling member 16 is made of a spring material and the pulling member 16 is connected to the retaining part 15. The erasing magnet member 5 is coupled to the pulling member 16. The amount of downward movement of the erasing magnet member 5 is substantially equal to the stroke of the operating member 7.

Figure 10:
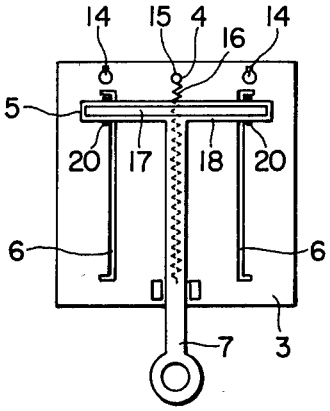
FIG. 10 is a front view showing another example of the device from which the panel with the magnetic displaying section has been removed.
Figure 11:
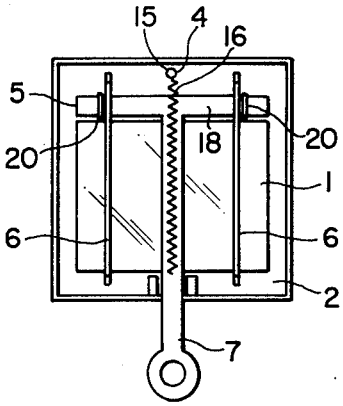
FIG. 11 is a rear view showing another example of the device from which the hanging panel removed.

The modification shown in FIG. 11 is produced by providing the erasing magnet member 5, magnet pulling member 4, magnet guide members 6 and operating member 7 shown in FIG. 10 on the panel 2 instead of the hanging panel 3. In this modification, each of the guide members 6 is made of a rail having a C-shaped section so that an erasing magnet member guiding clearance is formed between the panel 2 and the essential portions of the guide member 6.

Figure 12:
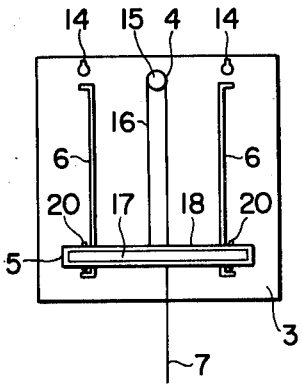
FIG. 12 through FIG. 19 are front views showing various examples of the device from each of which the magnetic displaying panel has been removed.

In the modification shown in FIG. 12, the magnet lifting member 4 is made of a retaining part 15 in the form of a pulley and a pulling member 16 made of a string, the pulling member 16 being laid over the retaining part 15 and connected to the operating member 17. The amount of upward movement of the erasing magnet member 5 is substantially equal to the stroke of the operating member 7.

Figure 13:
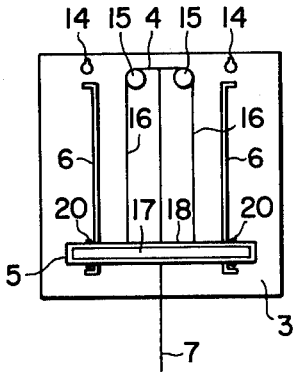

In the modification shown in FIG. 13, the magnet lifting member 4 includes two retaining parts 15, each in the form of a pulley, and two string pulling members 16 which are laid over the retaining parts 15 and connected to the erasing magnet member 5, respectively. Furthermore, the operating member 7 is a string connected to the other ends of the pulling member 16. The amount of upward movement of the erasing magnet member 5 is substantially equal to the stroke of the operating member 7.

Figure 14:
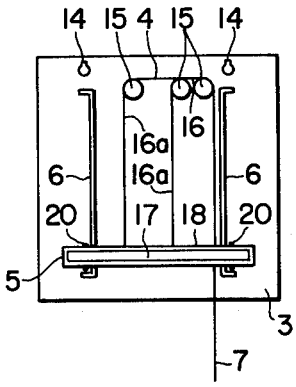

In the modification shown in FIG. 14, the magnet lifting member 4 includes a string pulling member 16 having two branches **16*a* at one end. The ends of the two branches are fastened to the erasing magnet member 5. The other end of the pulling member 16 is connected to the operating member 7. Furthermore, three pulley-shaped retaining parts 15 are provided over which the branches 16*a* and the operating member 7 are laid, respectively. As above, amount of upward movement of the erasing magnet member 5 is substantially equal to the stroke of the operating member 7**.

Figure 15:
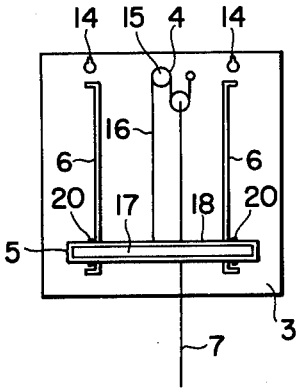

In the modification shown in FIG. 15, the magnet lifting member 4 has a pulley-shaped retaining part 15 and a string pulling member 16 which is laid over the retaining part 15 and is connected to the hanging panel 3 at one end. The operating member 7 is a movable block with a string. A part of the pulling member 16 is laid over the movable block. The stroke of the operating member 7 is substantially a half of the amount of upward movement of the erasing magnet member 5.

Figure 16:
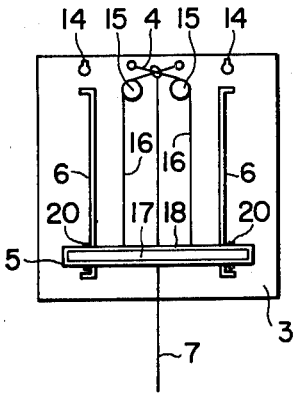

In the modification shown in FIG. 16, the magnet lifting member 4 includes two pulley-shaped retaining parts 15 and two string-like pulling member 16. The pulling members 16 are fastened to the erasing magnet member 5 at first ends thereof and are laid over the retaining parts 15, respectively. Furthermore, the second ends of the pulling members 16 are connected to the hanging panel 3 after the pulling members 16 are crossed with each other over the hanging panel 3. The operating member 7 is a string with a ring which is connected to the intersection of the two pulling members 16. The stroke of the operating member 7 is substantially a half of the amount of upward movement of the erasing magnet member 5.

Figure 17:
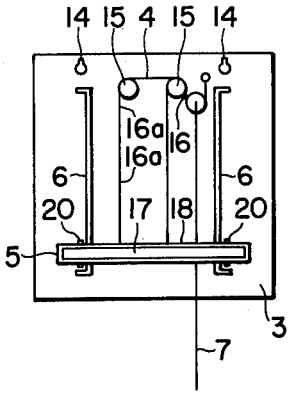

In the modification in FIG. 17, the magnet lifting member 4 is made of a string pulling member 16 having two branches **16*a* at one end and a two pulley-shaped retaining parts 15. The ends of the branches 16*a* are connected to the erasing magnet member 5 and the branches themselves are laid over the retaining parts 15, respectively. The other end of the pulling member 16 is connected to the hanging panel 3. The operating member 7 is a block with a string with the pulling member 16 laid over the block. The stroke of the operating member 7 in this case is substantially a half of the amount of upward movement of the erasing magnet member 5**.

Figure 18:
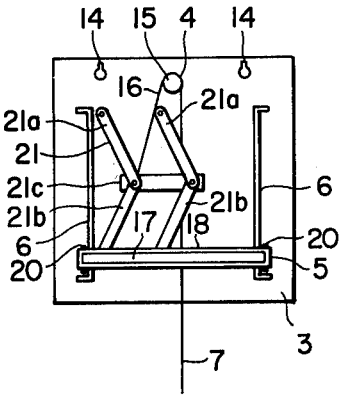

In the modification shown in FIG. 18, the erasing magnet member 5 is made of a magnet 17, a magnet holding member 18, and a link mechanism 21 which is provided between the magnet holding member 18 and the hanging panel 3 and is coupled thereto. The link mechanism 21 includes two link pieces **21*a* which are rotatably coupled to the hanging panel 3, two link pieces 21*b* which are rotatably coupled to the magnet holding member 18, and a common link piece 21*c* coupled to these link pieces 21*a* and 21*b*. The magnet lifting member 4 is made up of a pulley-shaped retaining part 15, and a string-like pulling member 16 which is laid over the retaining part 15 so as to also serve as the operating member 7. Accordingly, in this modification, the stroke of the operating member 7 is substantially a half of the upward movement of the erasing magnet member 5**.

Figure 19:
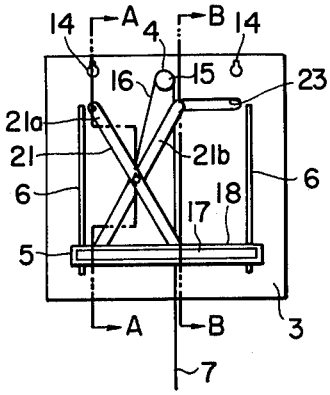
Figure 20:
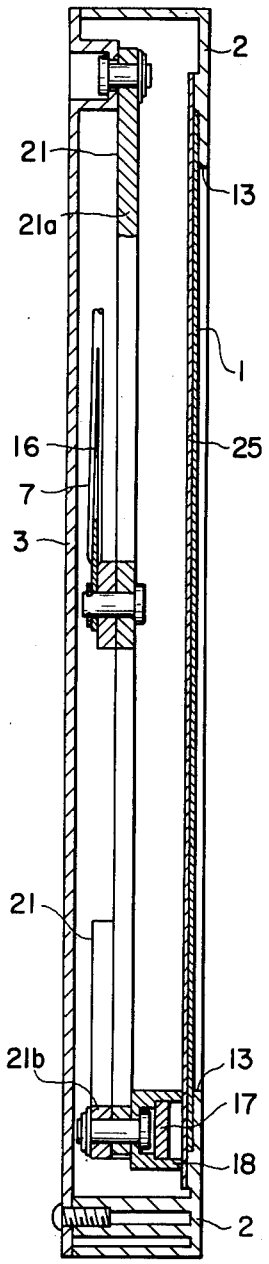
FIG. 20 is an enlarged sectional view taken along line A—A in FIG. 19.
Figure 21:
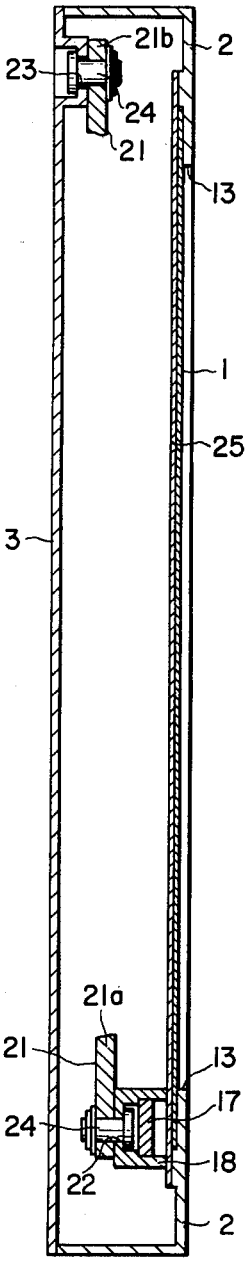
FIG. 21 is an enlarged sectional view taken along line B—B in FIG. 19.

The modification shown in FIG. 19 employs a link mechanism which is different from that in FIG. 8. The link mechanism is illustrated in FIGS. 20 and 21 in more detail. In the link mechanism 21 employed in this modification, two link pieces 21*a* and 21*b* are coupled to each other in such a manner that they cross each other and are rotatable with respect to each other. First ends of the two link pieces are rotatably connected to the hanging panel 3 and the magnet holding member 18, respectively, and the other ends are slidably coupled to the magnet holding member 18 and the hanging panel 3, respectively.

In these figures, reference numeral 22 designates an elongated hole formed in the magnet holding member 18, 23 an elongated hole formed in the hanging panel 3, and 24 screws provided on the link pieces 21*a* and 21*b*, the screws sliding along the elongated holes. Reference numeral 25 designates a metal plate forming the rear substrate of the magnetic displaying section 1 together with the substrate 10, the metal plate 25 being in close contact with the substrate 10. In this modification, the stroke of the operating member 7 is substantially a half of the upward movement of the erasing magnet member 5. When the erasing magnet 17 is moved, it is not shifted sideward because of the provision of the link mechanism constructed as described above. Accordingly, it is unnecessary to provide the aforementioned stopper receiver 20.

Figure 22:
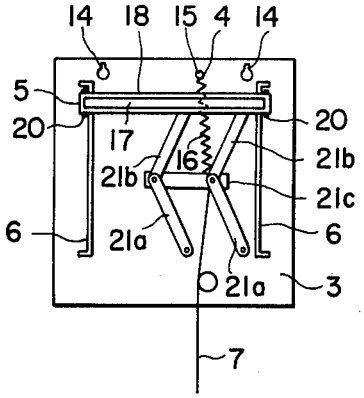
FIGS. 22 through 25 are front views showing various examples of the device from which the panels with the magnetic displaying sections have been removed.
Figure 23:
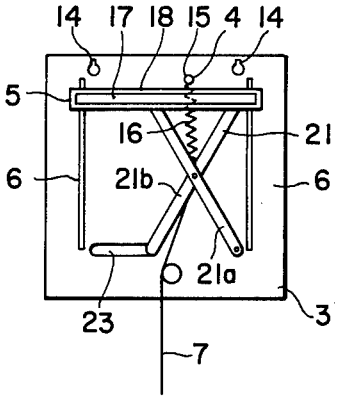

The modifications shown in FIGS. 22 and 23 can be produced essentially by turning upside down the devices shown in FIGS. 18 and 19, respectively, so that the erasing magnet members 5 are positioned above. That is, the magnets 7 remain above the link mechanism 21 at all times. In each modification, the magnet lifting member 4 includes a retaining part 15 and a pulling member 16 made of elastic material, the pulling member 16 being connected to the retaining part 15. The operating member 7 is a string connected to the erasing magnet member 5. In each modification, the stroke of the operating member 7 is substantially a half of the downward movement of the erasing magnet member 5.

Figure 24:
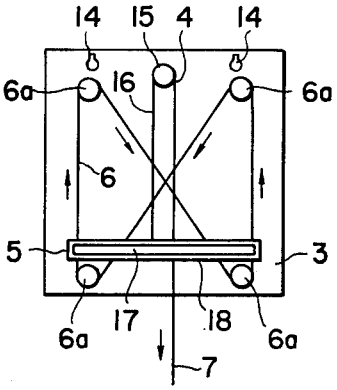

In the modification shown in FIG. 24, the magnet guide member 6 has four pulleys 6*a* provided respectively at the four corners of the hanging panel 3 and an endless string 6*b* which is laid over the four pulleys 6*a* in such a manner that two portions of the endless string cross with each other at all times. The endless string is fastened to the erasing magnet member 5 at two points. The magnet lifting member 4 includes a pulley-shaped retaining part 15 and a string-like pulling member 16 which is laid over the retaining part 15, the pulling member 16 serving also as the operating member. As the operating member 9 is pulled downwardly, the endless string 6*b* is moved in the direction of the arrow and accordingly the erasing magnet member 5 moves upwardly. The amount of upward movement of the erasing magnet member 5 is substantially equal to the stroke of the operating member 7.

Figure 25:
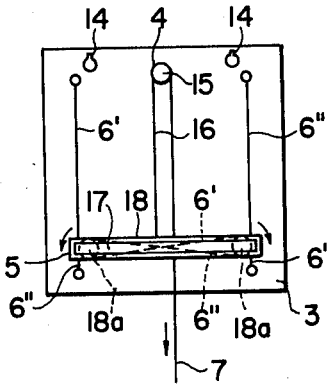
Figure 26:
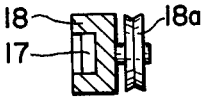
FIG. 26 is an enlarged sectional view showing the essential components of an erasing magnet member employed in the device shown in FIG. 25.

In the embodiment shown in FIG. 25, the magnet guide 6 is constructed of two string members 6' and 6'' arranged in such a manner that the ends of the string members are fastened to the four corners of the hanging panel 3 and the string members cross each other. Furthermore, the erasing magnet member 5 has pulleys 18*a* at both end portions of the magnet holding member 18 as in FIG. 26, and the aforementioned string members 6*a* and 6*b* are laid over the pulleys 18*a*, respectively, in such a manner that they cross each other as described above. The magnet lifting member 4 includes a pulley-shaped retaining part 15 and string pulling member serving as an operating member 7 which is laid over the retaining part 15. The pulleys 18*a* are rotated in the directions of the arrows by pulling down the operating member 7. The amount of upward movement of the erasing magnet member 5 is substantially equal to the stroke of the operating member 7.

Figure 27:
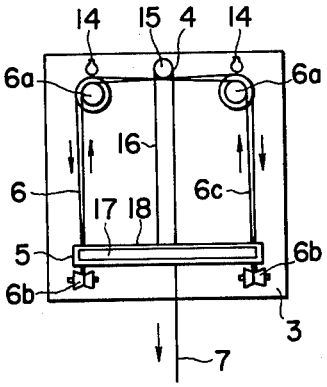
FIG. 27 is a front view showing another example of the device from which the panel with the magnet displaying section has been removed.
Figure 28:
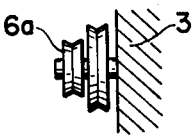
FIG. 28 is a sectional view showing the essential components of a magnet guide member employed in the device shown in FIG. 27.
Figure 29:
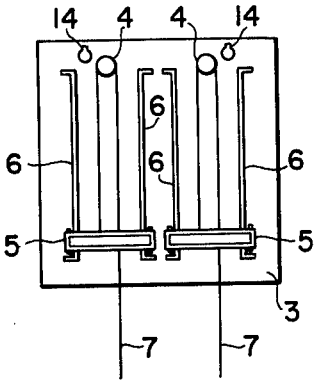
FIGS. 29 through 33 are front views showing other examples of the device from each of which the panel with the magnetic displaying section has been removed.
Figure 30:
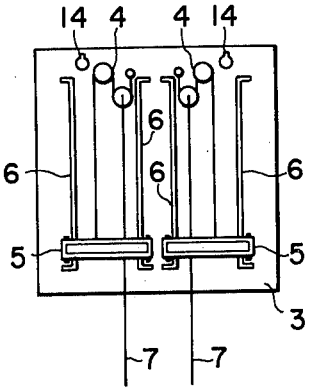
Figure 31:
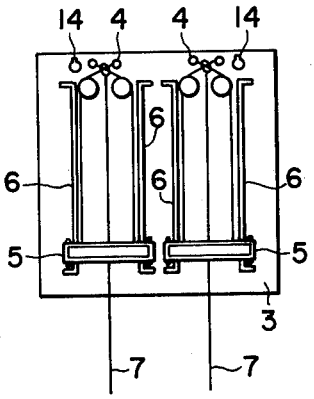
Figure 32:
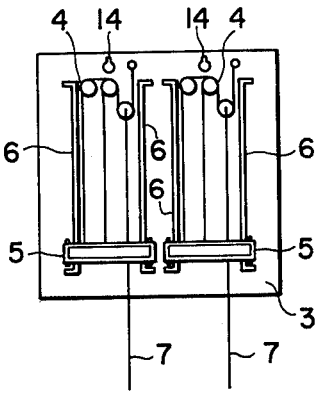
Figure 33:
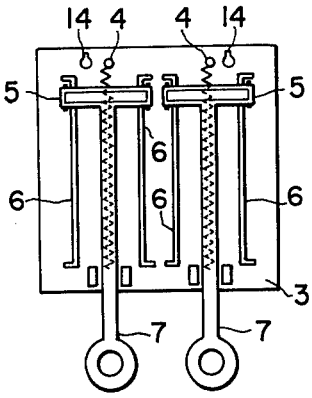

In the modification shown in FIG. 27, the magnet guide member 6 includes a pair of dual-pulleys 6*a* provided at two upper corners of the hanging panel 3 in such a manner that the shafts thereof are perpendicular to the hanging panel 3, a pair of pulleys 6*b* provided at two lower corners of the hanging panel 3 in wuch a manner that the shafts thereof are parallel with the hanging panel 3, and an endless string 6*c* which is laid over the four pulleys 6*a* and 6*b*. The erasing magnet member 5 is connected suitably to two portions of the endless string which are moved upwardly. The magnet lifting member 4 is constituted by a pulley-shaped retaining part 15 and a string pulling member serving also as an operating member 7 which is laid over the retaining part 15. As the operating member 7 is pulled downwardly, the string 6*c* moves in the directions of the arrows so that the erasing magnet member 5 moves upwardly. The amount of upward movement of the erasing magnet member 5 is substantially equal to the stroke of the operating member 7.

In each of the modifications shown in FIGS. 29 through 33, plural magnet lifting members 4, erasing magnet members 5, magnet guide members 6 and operating members 7 are provided on one hanging panel 3.

What is claimed is:

1. A wall-hanging type magnetic displaying device comprising:

A. A displaying panel comprising:

a. a hanging panel disposed parallel to a panel having a magnetic displaying section incorporating a liquid in which magnetic particles are dispersed, a predetermined space being provided between said hanging panel and said panel having a magnetic displaying section;

b. an erasing magnet member, means for moving said erasing magnet member including means for biasing said erasing magnet member in one direction and, means fixedly secured to at least one of said panels for retaining said biasing means;

c. said erasing magnet member having an elongated magnet arranged with the elongate direction perpendicular to the downward direction of said device hung and connected to one end of said biasing means so that said magnet is positioned at rest at an upper or lower end portion of said panel due to bias in one direction;

d. guide means provided on at least one of said panels for guiding said erasing magnet member; and e. operating means connected to one of said means for biasing and erasing magnet member so that said operating means extends along the downward direction of the device to move said erasing magnet member in a direction opposite to the bias direction and wherein upon release of said operating means said erasing magnet member reciprocates due to said bias to be restored to the rest position; and B. a displaying magnet adapted to move the magnetic particles in said dispersed liquid.

2. The device as claimed in claim 1 in which a plurality of sets of means for moving said erasing magnet members, erasing magnet members, guide means and operating means are provided on one hanging panel.

3. A device as claimed in claim 1 or 2 in which said biasing means comprises a spring and said operating means is coupled to said erasing magnet member.

4. A device as claimed in claim 1 or 2 in which said biasing means comprises a string member laid over said retaining means.

5. A device as claimed in claim 1 or 2 in which said magnet in said erasing magnet member of said displaying panel is spaced apart from the rear surface of said magnetic displaying section.

6. A device as claimed in claim 1 or 2 in which said erasing magnet member of said displaying panel further comprises a magnet holding means for holding said magnet.

7. A device as claimed in claim 1 or 2 in which said erasing magnet member of said displaying panel comprises: a magnet; a magnet holding means for holding said magnet; and a link mechanism provided between said magnet holding means and said panel and coupled to said magnet holding means and said panel in such a manner that said link mechanism is stretchable vertically.

8. A device as claimed in claim 1 or 2 in which said guide means of said displaying panel comprise rails.

9. A device as claimed in claim 1 or 2 in which said guide means of said displaying panel are string-like parts laid over pulleys.

10. A device as claimed in claim 1 or 2 in which said operating means of said displaying panel is rigid.

11. A device as claimed in claim 1 or 2 in which said operating means of said displaying panel is coupled to a string-like biasing means.

12. A device as claimed in claim 1 or 2 in which said displaying magnet is one in which a magnet is provided on the top of a cylindrical body.

* * * * *